US011049465B2

(12) United States Patent
Huang

(10) Patent No.: US 11,049,465 B2
(45) Date of Patent: Jun. 29, 2021

(54) DRIVING METHOD AND DRIVING DEVICE FOR DISPLAY PANEL AND DISPLAY DEVICE

(71) Applicant: HKC Corporation Limited, Shenzhen (CN)

(72) Inventor: Bei Zhou Huang, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/954,881

(22) PCT Filed: Jan. 10, 2018

(86) PCT No.: PCT/CN2018/072051
§ 371 (c)(1),
(2) Date: Jun. 17, 2020

(87) PCT Pub. No.: WO2019/119558
PCT Pub. Date: Jun. 27, 2019

(65) Prior Publication Data

US 2020/0402472 A1 Dec. 24, 2020

(30) Foreign Application Priority Data

Dec. 18, 2017 (CN) ..... 201711368981.5

(51) Int. Cl.
*G09G 3/36* (2006.01)

(52) U.S. Cl.
CPC ..... *G09G 3/3614* (2013.01); *G09G 3/3696* (2013.01)

(58) Field of Classification Search
CPC ..... G09G 3/3614; G09G 3/3696; G09G 2320/028; G09G 2320/0242
See application file for complete search history.

(56) References Cited

U.S. PATENT DOCUMENTS

| | | | | |
|---|---|---|---|---|
| 10,643,558 | B2 * | 5/2020 | Su | G09G 3/3607 |
| 10,657,872 | B2 * | 5/2020 | Tien | G09G 3/2074 |
| 2016/0071473 | A1 * | 3/2016 | Ahn | G09G 3/3648 345/690 |
| 2016/0253973 | A1 * | 9/2016 | Nishida | G02F 1/134309 345/209 |

FOREIGN PATENT DOCUMENTS

| | | | |
|---|---|---|---|
| CN | 1317778 | A | 10/2001 |
| CN | 105185326 | A | 12/2015 |
| CN | 105304010 | A | 2/2016 |

* cited by examiner

*Primary Examiner* — Andrew Sasinowski
(74) *Attorney, Agent, or Firm* — WPAT, PC

(57) ABSTRACT

The disclosure relates to a driving method and a driving device for a display panel, and a display device, wherein the display panel includes a plurality of first pixel units and a plurality of second pixel units disposed adjacently, the driving method includes dividing a plurality of pixel units of the display panel into a plurality of pixel unit groups, each of the pixel unit groups including two columns of adjacent pixel units; driving sub-pixels in corresponding positions in each adjacent two of the pixel unit groups by adopting drive voltages of opposite polarities; driving first position sub-pixels and second position sub-pixels in a same pixel unit by adopting drive voltages of opposite polarities; and driving the sub-pixels in the first pixel units and sub-pixels in the second pixel units respectively by adopting drive voltages of different voltage levels.

20 Claims, 4 Drawing Sheets

20

| n | | n+1 | |
|---|---|---|---|
| P1(i, j)<br>H | P2(i, j+1)<br>L | P1(i, j+2)<br>H | P2(i, j+3)<br>L |
| P2(i+1, j)<br>L | P1(i+1, j+1)<br>H | P2(i+1, j+2)<br>L | P1(i+1, j+3)<br>H |
| P1(i+2, j)<br>H | P2(i+2, j+1)<br>L | P1(i+2, j+2)<br>H | P2(i+2, j+3)<br>L |
| P2(i+3, j)<br>L | P1(i+3, j+1)<br>H | P2(i+3, j+2)<br>L | P1(i+3, j+3)<br>H |

20 n n+1

P1(i, j)

| | | | | | | | | | | | | | | | |
|---|---|---|---|---|---|---|---|---|---|---|---|---|---|---|---|
| R1<br>H+<br>(i, j) | G1<br>H−<br>(i, j) | B1<br>H−<br>(i, j) | W1<br>H+<br>(i, j) | R2<br>L+<br>(i, j+1) | G2<br>L−<br>(i, j+1) | B2<br>L−<br>(i, j+1) | W2<br>L+<br>(i, j+1) | R1<br>H−<br>(i, j+2) | G1<br>H+<br>(i, j+2) | B1<br>H+<br>(i, j+2) | W1<br>H−<br>(i, j+2) | R2<br>L−<br>(i, j+3) | G2<br>L+<br>(i, j+3) | B2<br>L+<br>(i, j+3) | R2<br>L−<br>(i, j+3) |
| R2<br>L+<br>(i+1, j) | G2<br>L−<br>(i+1, j) | B2<br>L−<br>(i+1, j) | W2<br>L+<br>(i+1, j) | R1<br>H+<br>(i+1, j+1) | G1<br>H−<br>(i+1, j+1) | B1<br>H−<br>(i+1, j+1) | W1<br>H+<br>(i+1, j+1) | R2<br>L−<br>(i+1, j+2) | G2<br>L+<br>(i+1, j+2) | B2<br>L+<br>(i+1, j+2) | W2<br>L−<br>(i+1, j+2) | R1<br>H−<br>(i+1, j+3) | G1<br>H+<br>(i+1, j+3) | B1<br>H+<br>(i+1, j+3) | R1<br>H−<br>(i+1, j+3) |
| R1<br>H+<br>(i+2, j) | G1<br>H−<br>(i+2, j) | B1<br>H−<br>(i+2, j) | W1<br>H+<br>(i+2, j) | R2<br>L+<br>(i+2, j+1) | G2<br>L−<br>(i+2, j+1) | B2<br>L−<br>(i+2, j+1) | W2<br>L+<br>(i+2, j+1) | R1<br>H−<br>(i+2, j+2) | G1<br>H+<br>(i+2, j+2) | B1<br>H+<br>(i+2, j+2) | W1<br>H−<br>(i+2, j+2) | R2<br>L−<br>(i+2, j+3) | G2<br>L+<br>(i+2, j+3) | B2<br>L+<br>(i+2, j+3) | R2<br>L−<br>(i+2, j+3) |
| R2<br>L+<br>(i+3, j) | G2<br>L−<br>(i+3, j) | B2<br>L−<br>(i+3, j) | W2<br>L+<br>(i+3, j) | R1<br>H+<br>(i+3, j+1) | G1<br>H−<br>(i+3, j+1) | B1<br>H−<br>(i+3, j+1) | W1<br>H+<br>(i+3, j+1) | R2<br>L−<br>(i+3, j+2) | G2<br>L+<br>(i+3, j+2) | B2<br>L+<br>(i+3, j+2) | W2<br>L−<br>(i+3, j+2) | R1<br>H−<br>(i+3, j+3) | G1<br>H+<br>(i+3, j+3) | B1<br>H+<br>(i+3, j+3) | R1<br>H−<br>(i+3, j+3) |

FIG. 3 n

| | | | | | | | |
|---|---|---|---|---|---|---|---|
| R1<br>H−<br>(i, j) | G1<br>H+<br>(i, j) | B1<br>H+<br>(i, j) | W1<br>H−<br>(i, j) | R2<br>L−<br>(i, j+1) | G2<br>L+<br>(i, j+1) | B2<br>L+<br>(i, j+1) | W2<br>L−<br>(i, j+1) |
| R2<br>L−<br>(i+1, j) | G2<br>L+<br>(i+1, j) | B2<br>L+<br>(i+1, j) | W2<br>L−<br>(i+1, j) | R1<br>H−<br>(i+1, j+1) | G1<br>H+<br>(i+1, j+1) | B1<br>H+<br>(i+1, j+1) | W1<br>H−<br>(i+1, j+1) |
| R1<br>H−<br>(i+2, j) | G1<br>H+<br>(i+2, j) | B1<br>H+<br>(i+2, j) | W1<br>H−<br>(i+2, j) | R2<br>L−<br>(i+2, j+1) | G2<br>L+<br>(i+2, j+1) | B2<br>L+<br>(i+2, j+1) | W2<br>L−<br>(i+2, j+1) |
| R2<br>L−<br>(i+3, j) | G2<br>L+<br>(i+3, j) | B2<br>L+<br>(i+3, j) | W2<br>L−<br>(i+3, j) | R1<br>H−<br>(i+3, j+1) | G1<br>H+<br>(i+3, j+1) | B1<br>H+<br>(i+3, j+1) | W1<br>H−<br>(i+3, j+1) |

FIG. 4

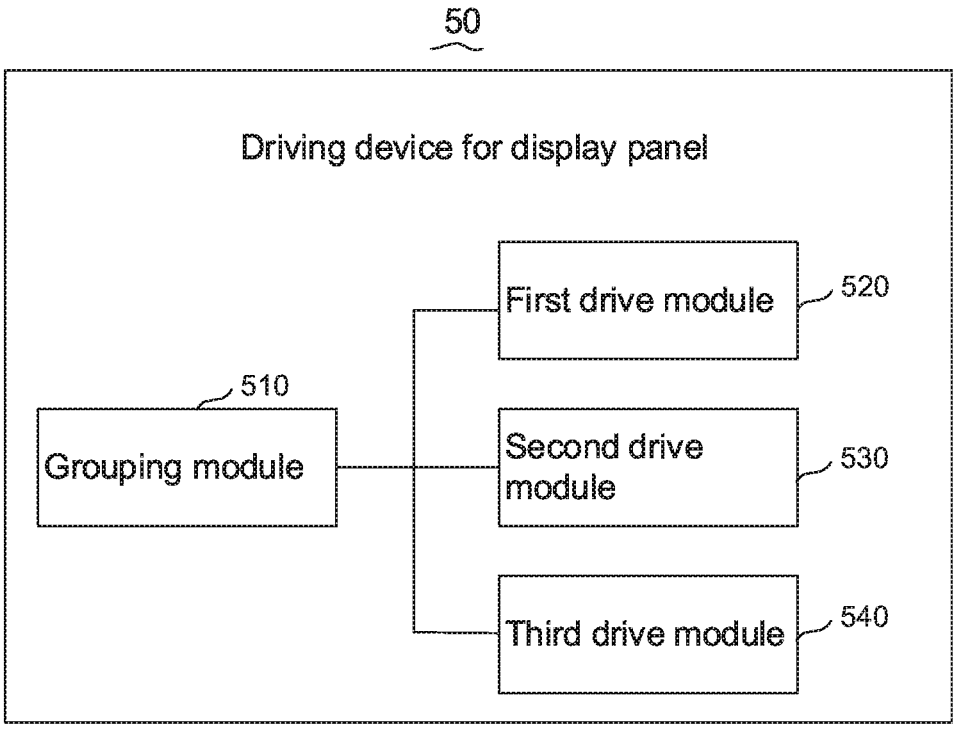

FIG. 5

DRIVING METHOD AND DRIVING DEVICE FOR DISPLAY PANEL AND DISPLAY DEVICE

FIELD OF THE DISCLOSURE

The disclosure relates to the field of display technologies and more particularly to a driving method and a driving device for a display panel and a display device.

BACKGROUND

For a current common display panel, due to reasons of a deflection angle of liquid crystal molecules or light-emitting stability of an organic light-emitting diode (OLED) device, and the like, generally, there exists a problem of color cast to some extent.

In order to improve the problem of color cast, a common driving method for the display panel is to apply two kinds of high and low drive voltage signals to each adjacent two of the pixel units respectively, and apply drive voltages of opposite polarities to every adjacent two sub-pixels at a same moment. By adopting such a manner, although the problem of color cast can be improved, mismatch of the high voltage positive and negative polarities of a same row of sub-pixels will be caused, that is, an amount of the sub-pixels of positive polarity high voltage is inconsistent with an amount of the sub-pixels of negative polarity high voltage. Hence, due to an influence of stray capacitance, when the amount of the sub-pixels of positive polarity high voltage is more than the amount of the sub-pixels of negative polarity high voltage, the equivalent voltage of a common voltage $V_{com}$ is improved compared with the original $V_{com}$, as a result, actual charging charges of the sub-pixels of positive polarity high voltage are increased, and the brightness is increased, and on the contrary, actual charging charges of the sub-pixels of negative polarity high voltage are increased, and the brightness is reduced, thereby affecting display colors and a picture quality, and generating the problem of abnormal picture quality output.

SUMMARY

According to respective embodiments of the disclosure, there are provided a driving method and a driving device for a display panel, and a display device, which can prevent a $V_{com}$ voltage from an interference, ensures correctness of an image signal and improves a picture display quality.

The present disclosure provides a driving method for a display panel. The method includes: dividing a plurality of pixel units of the display panel into a plurality of pixel unit groups, each of the pixel unit groups comprising two columns of adjacent pixel units, wherein the pixel units comprises first pixel units and second pixel units; driving sub-pixels in corresponding positions in each adjacent two of the pixel unit groups by adopting drive voltages of opposite polarities; driving first position sub-pixels and second position sub-pixels in a same pixel unit by adopting drive voltages of opposite polarities; driving the sub-pixels in the first pixel units and sub-pixels in the second pixel units respectively by adopting drive voltages of different voltage levels. Wherein the first pixel units and the second pixel units are disposed adjacently in the display panel.

In one embodiment, each of the pixel units comprises a first sub-pixel, a second sub-pixel, a third sub-pixel and a fourth sub-pixel arranged in sequence; driving first position sub-pixels and second position sub-pixels in a same pixel unit by adopting drive voltages of opposite polarities comprises: driving the first sub-pixel and the second sub-pixel in a same pixel unit by adopting drive voltages of opposite polarities; driving the fourth sub-pixel in the same pixel unit by adopting a drive voltage same as a polarity of the first sub-pixel; and driving the third sub-pixel in the same pixel unit by adopting a drive voltage same as a polarity of the second sub-pixel.

In one embodiment, the driving method further comprises driving a same column of sub-pixels by adopting a driving voltage of a same polarity.

In one embodiment, the driving method further comprises driving the sub-pixels in corresponding positions in respective pixel units by adopting a drive voltage of a same polarity in the same pixel unit group.

In one embodiment, the driving method further comprises driving the same sub-pixel by adopting the drive voltages of opposite polarities in every adjacent two frame display time.

In one embodiment, each of the pixel units comprises a first sub-pixel, a second sub-pixel, a third sub-pixel and a fourth sub-pixel arranged in sequence; driving first position sub-pixels and second position sub-pixels in a same pixel unit by adopting drive voltages of opposite polarities comprises: driving the first sub-pixel and the second sub-pixel in a same pixel unit by adopting drive voltages of opposite polarities; driving the fourth sub-pixel in the same pixel unit by adopting a drive voltage same as a polarity of the first sub-pixel; and driving the third sub-pixel in the same pixel unit by adopting a drive voltage same as a polarity of the second sub-pixel; besides, the driving method further comprises: driving a same column of sub-pixels by adopting a driving voltage of a same polarity; driving the sub-pixels in corresponding positions in respective pixel units by adopting a drive voltage of a same polarity in the same pixel unit group; and driving the same sub-pixel by adopting the drive voltages of opposite polarities in every adjacent two frame display time.

In one embodiment, the display panel is a liquid crystal panel.

The present disclosure also provides a driving device for a display panel. The driving device includes: a grouping module, configured for dividing a plurality of pixel units of the display panel into a plurality of pixel unit groups, each of the pixel unit groups comprising two columns of adjacent pixel units; a first drive module, configured for driving sub-pixels in corresponding positions in each adjacent two of the pixel unit groups by adopting drive voltages of opposite polarities; a second drive module, configured for driving first position sub-pixels and second position sub-pixels in a same pixel unit by adopting drive voltages of opposite polarities; a third drive module, configured for driving the sub-pixels in first pixel units and sub-pixels in second pixel units respectively by adopting drive voltages of different voltage levels. Wherein the first pixel units and the second pixel units are disposed adjacently in the display panel.

In one embodiment, each of the pixel units comprises a first sub-pixel, a second sub-pixel, a third sub-pixel and a fourth sub-pixel arranged in sequence; the second drive module comprises: a first drive unit, configured for driving the first sub-pixel and the second sub-pixel in a same pixel unit by adopting drive voltages of opposite polarities; a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel.

In one embodiment, the driving device further comprises a fourth drive module, configured for driving a same column of sub-pixels by adopting a driving voltage of a same polarity.

In one embodiment, the driving device further comprises a fifth drive module, configured for driving the sub-pixels in corresponding positions in respective pixel units by adopting a drive voltage of a same polarity in the same pixel unit group.

In one embodiment, the driving device further comprises a sixth drive module, configured for driving the same sub-pixel by adopting the drive voltages of opposite polarities in every adjacent two frame display time.

In one embodiment, each of the pixel units comprises a first sub-pixel, a second sub-pixel, a third sub-pixel and a fourth sub-pixel arranged in sequence; the second drive module comprises: a first drive unit, configured for driving the first sub-pixel and the second sub-pixel in a same pixel unit by adopting drive voltages of opposite polarities; a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel; the driving device further comprises: a fourth drive module, configured for driving a same column of sub-pixels by adopting a driving voltage of a same polarity; a fifth drive module, configured for driving the sub-pixels in corresponding positions in respective pixel units by adopting a drive voltage of a same polarity in the same pixel unit group; and a sixth drive module, configured for driving the same sub-pixel by adopting the drive voltages of opposite polarities in every adjacent two frame display time.

In one embodiment, the display panel is a liquid crystal panel.

The present disclosure also provides a display device. The display device including a display panel and an above driving device connected to the display panel.

According to the above driving method and driving device for a display panel, and a display device, an amount of the sub-pixels applied with a positive polarity high voltage level drive voltage equals to an amount of the sub-pixels applied with a negative polarity high voltage level drive voltage, such that the $V_{com}$ voltage is prevented from affected by stray capacitance, thereby ensuring correctness of an image signal and avoiding a phenomenon of color cast or abnormal picture quality.

BRIEF DESCRIPTION OF THE DRAWINGS

In order to more dearly explain technical solutions of the disclosure or prior art, the drawings required in description of the embodiments or the prior art will be briefly introduced. It is obvious that the described drawings below are some embodiments of the present disclosure, and those ordinary skilled in the art can acquire other drawings according to these drawings, without paying any inventive work.

FIG. 3 is a schematic view of drive voltages for sub-pixels in a plurality of pixel units of a display panel according to one embodiment of the disclosure.

FIG. 4 is a schematic view of drive voltages for sub-pixels in a plurality of pixel units of a display panel according to another embodiment of the disclosure.

FIG. 5 is a structural schematic view of a driving device for a display panel according to one embodiment of the disclosure.

DETAILED DESCRIPTION OF PREFERRED EMBODIMENTS

Figures 1, 2:
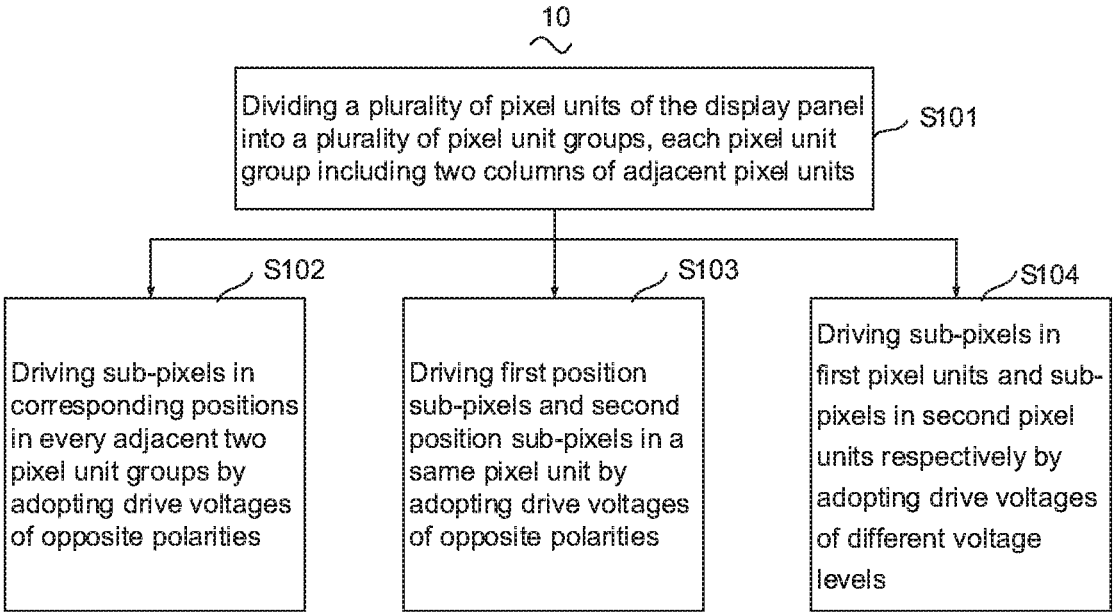
FIG. 1 is a flow schematic view of a driving method for a display panel according to one embodiment of the disclosure.
FIG. 2 is a schematic view of drive voltages for a plurality of pixel units in a display panel according to one embodiment of the disclosure.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms used herein are only for illustrating concrete embodiments rather than limiting the exemplary embodiments. Unless otherwise indicated in the content, singular forms "a" and "an" also include plural. Moreover, the terms "comprise" and/or "include" define the existence of described features, integers, steps, operations, units and/or components, but do not exclude the existence or addition of one or more other features, integers, steps, operations, units, components and/or combinations thereof.

For example, a driving method for a display panel includes dividing a plurality of pixel units of the display panel into a plurality of pixel unit groups, each of the pixel unit groups including two columns of adjacent pixel units; driving sub-pixels in corresponding positions in each adjacent two of the pixel unit groups by adopting drive voltages of opposite polarities; driving first position sub-pixels and second position sub-pixels in a same pixel unit by adopting drive voltages of opposite polarities; driving the sub-pixels in first pixel units and sub-pixels in second pixel units respectively by adopting drive voltages of different voltage levels; wherein the first pixel units and the second pixel units are disposed adjacently in the display panel.

A driving device for a display panel includes a grouping module, configured for dividing a plurality of pixel units of the display panel into a plurality of pixel unit groups, each of the pixel unit groups including two columns of adjacent pixel units; a first drive module, configured for driving sub-pixels in corresponding positions in each adjacent two of the pixel unit groups by adopting drive voltages of opposite polarities; a second drive module, configured for driving first position sub-pixels and second position sub-pixels in a same pixel unit by adopting drive voltages of opposite polarities; a third drive module, configured for driving the sub-pixels in first pixel units and sub-pixels in second pixel units respectively by adopting drive voltages of different voltage levels; wherein the first pixel units and the second pixel units are disposed adjacently in the display panel.

For example, a display device includes a display panel and the above driving device.

Wherein the display panel has a plurality of pixel units distributed in a matrix, for example, the display panel has a plurality of pixel units and a plurality of second pixel units disposed adjacently. Besides, each pixel unit includes a plurality of sub-pixels, for example, each pixel unit at least includes a red sub-pixel, a green sub-pixel and a blue sub-pixel. Optionally, each pixel unit further may further include a white sub-pixel.

In order to further understand the driving method and driving device for a display panel and the display device. The drawings are combined below for explanation.

Referring to FIGS. 1 to 2, wherein FIG. 1 is a flow schematic view of a driving method for a display panel according to one embodiment of the disclosure, and the driving method is applied to the display panel. As shown in FIG. 1, the driving method 10 includes the following steps S101 dividing a plurality of pixel units of the display panel into a plurality of pixel unit groups, each of the pixel unit groups including two columns of adjacent pixel units.

Specifically, as shown in FIG. 2, the display panel 20 has a plurality of pixel units distributed in a matrix, the plurality of pixel units include a plurality of first pixel units P1 and a plurality of second pixel units P2, the first pixel units and the second pixel units are disposed adjacently, or the first pixel units and the second pixel units are alternately arranged. For example, as shown in FIG. 2, the pixel units adjacent to the first pixel units are all second pixel units, and the pixel units adjacent to the second pixel units are all first pixel units.

Specifically, each pixel unit includes a plurality of sub-pixels, that is, the first pixel unit includes a plurality of sub-pixels, the second pixel unit also includes a plurality of sub-pixels, and respective embodiments are by that analogy. For example, each pixel unit includes a plurality of sub-pixels of different colors, for example, each pixel unit includes three sub-pixels of a red (R) sub-pixel, a green (G) sub-pixel and a blue (B) sub-pixel respectively. Or each pixel unit includes four sub-pixels of a red (R) sub-pixel, a green (G) sub-pixel, a blue (B) sub-pixel and a white (W) sub-pixel respectively.

S102 driving sub-pixels in corresponding positions in each adjacent two of the pixel unit groups by adopting drive voltages of opposite polarities.

As an embodiment, the drive voltage is applied to each sub-pixel in the display panel, such that the polarities of the drive voltages in corresponding positions in each adjacent two of the pixel unit groups are opposite.

Wherein the corresponding positions refer to consistent relative positions or consistent arrangement sequence, for example, the first column and first row of sub-pixel arranged in the first pixel unit group and the first column and first row of sub-pixel arranged in the second pixel unit group, both of them are sub-pixels in corresponding positions, and the drive voltages of opposite polarities are applied to these two sub-pixels.

S103 driving first position sub-pixels and second position sub-pixels in a same pixel unit by adopting drive voltages of opposite polarities.

As an embodiment, according to positions of the sub-pixels, the plurality if sub-pixels in each pixel group are divided into first position sub-pixels and second position sub-pixels. Wherein the first position and the second position are a middle position and an edge position respectively. For example, the first position sub-pixels are middle position sub-pixels, and the second position sub-pixels are edge position sub-pixels. Or the first position sub-pixels are edge position sub-pixels, and the second position sub-pixels are middle position sub-pixels.

For another example, by taking the middle position sub-pixels as the first position sub-pixels and the edge position sub-pixels as the second position sub-pixels as an example, if the pixel unit includes the R sub-pixel, the G sub-pixel and the B sub-pixel arranged in sequence, then the first position sub-pixel includes the G sub-pixel, and the second position sub-pixels include the R sub-pixel and the B sub-pixel. At this point, the drive voltage of a first polarity is applied to the G sub-pixel in the same pixel unit, and the drive voltage of a second polarity is applied to the R sub-pixel and the B sub-pixel in the same pixel unit, such that in the same pixel unit, the polarities of the drive voltages of the middle position sub-pixels and the edge sub-pixels are opposite.

If the pixel unit includes the R sub-pixel, the G sub-pixel, the B sub-pixel and the W sub-pixel arranged in sequence, then the first position sub-pixels include the G sub-pixel and the B sub-pixel, and the second position sub-pixels include the R sub-pixel and the W sub-pixel. At this point, the drive voltage of a first polarity is applied to the G sub-pixel and the B sub-pixel in the same pixel unit, and the drive voltage of a second polarity is applied to the R sub-pixel and the W sub-pixel in the same pixel unit, such that in the same pixel unit, the polarities of the drive voltages of the middle position sub-pixels and the edge sub-pixels are opposite.

Wherein the first polarity is positive polarity, and the second polarity is negative polarity. Or the first polarity is the negative polarity and the second polarity is the positive polarity. The positive polarity refers to that a size of the drive voltage is larger than a preset common voltage $V_{com}$ of the display panel, that is, a voltage difference between the drive voltage and the $V_{com}$ is larger than 0. The negative polarity refers to that a size of the drive voltage is smaller than a preset common voltage $V_{com}$, that is, a voltage difference between the drive voltage and the $V_{com}$ is smaller than 0.

S104 driving sub-pixels in the first pixel units and sub-pixels in the second pixel units respectively by adopting drive voltages of different voltage levels.

As an embodiment, the drive voltage of a first voltage level is applied to the sub-pixels in the first pixel units, and the drive voltage of a second voltage level is applied to the sub-pixels in the second pixel units.

Specifically, the drive voltage levels respectively corresponding to the first position units and the second position units are preset, for example, a first drive voltage level corresponding to the first pixel units and a second drive voltage level corresponding to the second pixel units are preset. Wherein in the first drive voltage level and the second drive voltage level, one is a high voltage level and the other is a low voltage level. For example, the first drive voltage level is higher than the second drive voltage level, or the first drive voltage level is lower than the second drive voltage level. Since the first pixel units and the second pixel units are disposed adjacently in the display panel. In this way, the voltage levels of the drive voltages of each adjacent two of the pixel units are different, such that a gray scale brightness curve of the pixel units under a side viewing angle is close to the gray scale brightness curve under a front viewing angle, thereby improving the problem of color cast under the side viewing angle. As an embodiment, the first drive voltage level and the second drive voltage level are interchanged once every a preset time period, that is, every time period or every preset time period, the first drive voltage level and the second drive voltage level are updated, the first drive voltage level is set to be the original second drive voltage level, and the second drive voltage level is set to be the original first drive voltage level, in this way, on the basis that a gray scale brightness curve of the pixel unit under a side viewing angle is close to the gray scale brightness curve under a front viewing angle, long term operation is further ensured to achieve a uniform display effect. Further, the preset time period is set or adjusted according to adjacent two frame display time, or the preset time period is set or adjusted according to a frame frequency, that is to say, for different frame frequencies, the preset time period is different, thus, it can be ensured that the display panels of different display purposes have proper preset time periods. Therefore, the display of the display panel can be adapted when the first drive voltage level and the second drive voltage level are adjusted. Further, the preset time period is in direct proportion to the adjacent two frame display time, or the preset time period is in inverse proportion to the frame frequency of the display panel. For example, the longer the adjacent two frame display time is, the longer the preset time period is, or the larger the frame frequency is, the smaller the preset time period is, and so on. Further, the driving method further includes presetting the preset time period. Further, the driving method further includes presetting an amplitude of variation coefficient range. Besides, interchanging the first drive voltage level and the second drive voltage level once ever preset time period includes interchanging the first drive voltage level and the second drive voltage level once ever preset time period and in the interchanging process, and randomly obtaining an amplitude of variation coefficient according to the amplitude of variation range. For example, every preset time period, the first drive voltage level and the second drive voltage level are updated, the first drive voltage level is set to be a product of the original second drive voltage level multiplied by an amplitude of variation coefficient randomly obtained from the amplitude of variation coefficient range, and the second drive voltage level is set to be a product of the original first drive voltage level multiplied by an amplitude of variation coefficient randomly obtained from the amplitude of variation coefficient range. For example, in the interchanging process, the two amplitude of variation coefficients are same or different. For example, every preset time period, the first drive voltage level and the second drive voltage level are updated, the amplitude of variation coefficient is randomly obtained from the amplitude of variation coefficient range, the first drive voltage level is set to be a product of the original second drive voltage level multiplied by the amplitude of variation coefficient, and the second drive voltage level is set to be a product of the original first drive voltage level multiplied by the amplitude of variation coefficient. It is understandable that different voltage levels correspond to different drive voltages. In this way, on the basis that a gray scale brightness curve of the pixel unit under a side viewing angle is close to the gray scale brightness curve under a front viewing angle, long term operation is further ensured to achieve a uniform display effect, better protection for the display panel is formed, and such design is favorable for improving a picture display quality.

In one of the embodiments, in the driving method, the pixel unit includes a first sub-pixel, a second sub-pixel, a third sub-pixel and a fourth sub-pixel arranged in sequence. Driving first position sub-pixels and second position sub-pixels in a same pixel unit by adopting drive voltages of opposite polarities includes driving the first sub-pixel and the second sub-pixel in a same pixel unit by adopting drive voltages of opposite polarities; driving the fourth sub-pixel in the same pixel unit by adopting a drive voltage same as a polarity of the first sub-pixel; and driving the third sub-pixel in the same pixel unit by adopting a drive voltage same as a polarity of the second sub-pixel. The driving method further includes driving a same column of sub-pixels by adopting a driving voltage of a same polarity, driving the sub-pixels in corresponding positions in respective pixel units by adopting a drive voltage of a same polarity in the same pixel unit group, and driving the same sub-pixel by adopting the drive voltages of opposite polarities in every adjacent two frame display time.

Wherein the column and row in the embodiment of the disclosure represent two arrangement directions vertical to each other, for example, the column represents a longitudinal direction and the row represents a transverse direction; and for another example, the column represents the transverse direction and the row represents the longitudinal direction. That is, the column in the embodiment of the disclosure may be the row understood by those ordinary skilled in the art, and the row in the embodiment of the disclosure may be the column understood by those ordinary skilled in the art.

In actual application, the steps S102, S103 and S104 can be performed simultaneously. That is, the drive voltage is applied to each sub-pixel in the display panel, such that the polarities of the drive voltages of the sub-pixels in corresponding positions in each adjacent two of the pixel unit groups are opposite, the polarities of the drive voltages of the first position sub-pixels and the second position sub-pixels in the same pixel unit are opposite, and the drive voltage levels of the first pixel units and the second pixel units are different. In this way, not only are the voltage levels of the drive voltages of each adjacent two of the pixel units different and is the problem of color cast under the side viewing angle improved, but also in each row of pixels of the display panel, an amount of the sub-pixels with the drive voltage being the positive polarity high voltage level is equal to an amount of the sub-pixels with the drive voltage being the negative polarity high voltage level, such that the $V_{com}$ is prevented from being affected by stray capacitance, thereby ensuring correctness of an image signal, and avoiding a phenomenon of a color cast or abnormal picture quality.

Referring to FIGS. 2 and 3, wherein P1 represents the first pixel unit, and P2 represents the second pixel unit, by taking a fact that each pixel unit includes a red sub-pixel, a green sub-pixel, a blue sub-pixel and a white sub-pixel respectively as an example, R1, G1, B1 and W1 represent the red sub-pixel, the green sub-pixel, the blue sub-pixel and the white sub-pixel in the first pixel unit respectively, and R2, G2, B2 and W2 represent the red sub-pixel, the green sub-pixel, the blue sub-pixel and the white sub-pixel in the second pixel unit respectively. H represents a first drive voltage level, L represents a second drive voltage level, (i, j) represents the ith row and jth column, (i, j+1) represents the ith row and (j+1)th column, (i+1, j) represents the (i+1)th row and jth column, and so on.

As shown in FIG. 2, according to the step S101, the 4 columns of jth to (j+3)th columns of pixel units are divided into two pixel unit groups, which a nth pixel unit group and a (n+1) pixel unit group, such that each of the pixel unit groups contains two columns of adjacent pixel units, for example, the nth pixel unit includes adjacent jth and (j+1) columns of pixels, and the (n+1)th pixel unit includes adjacent (j+2)th and (j+3) columns of pixels.

According to the step S102, the sub-pixels in the corresponding positions in each adjacent two of the pixel unit groups are driven by adopting the drive voltages of opposite polarities. As shown in FIG. 3, the sub-pixel R1 (i, j) in the first column and ith row in the nth pixel unit group and the sub-pixel R1 (i, j+2) in the first column and ith row in the (n+1)th pixel unit group are two sub-pixels in corresponding positions, the drive voltage of positive polarity is applied to the sub-pixel R1(i, j), and the drive voltage of negative polarity is applied to the sub-pixel R1(i, j+2), such that the polarities of the drive voltages of the two sub-pixels are opposite. For another example, the sub-pixel G1 (i, j) in the second column and ith row in the nth pixel unit group and the sub-pixel G1 (i, j+2) in the second column and ith row in the (n+1)th pixel unit group are two sub-pixels in corresponding positions, the drive voltage of positive polarity is applied to the sub-pixel G1(i, j), and the drive voltage of negative polarity is applied to the sub-pixel G1(i, j+2), such that the polarities of the drive voltages of the two sub-pixels are opposite, and so on.

According to the step S103, the first position sub-pixels and the second position sub-pixels in the same pixel unit are driven by adopting the drive voltages of opposite polarities. As an embodiment, the pixel unit includes a first sub-pixel, a second sub-pixel, a third sub-pixel and a fourth sub-pixel arranged in sequence, wherein the second sub-pixel and the third sub-pixel are second position sub-pixels, and the first sub-pixel and the fourth sub-pixel are second position sub-pixels. Then the step S103 includes driving the first sub-pixel and the second sub-pixel in a same pixel unit by adopting drive voltages of opposite polarities; driving the fourth sub-pixel in the same pixel unit by adopting a drive voltage same as a polarity of the first sub-pixel; and driving the third sub-pixel in the same pixel unit by adopting a drive voltage same as a polarity of the second sub-pixel. As shown in FIG. 3, by taking the pixel P1 (i, j) as an example, it includes a first sub-pixel R1 (i, j), a second sub-pixel G1 (i, j), a third sub-pixel B1 (i, j) and a fourth sub-pixel W1 (i, j), wherein the first sub-pixel R1 (i, j) and the fourth sub-pixel W1(i, j) are first position sub-pixels, the second sub-pixel G1(i, j) and the third sub-pixel B1 (i, j) are second position sub-pixels, then in certain frame picture display time, the drive voltage of positive polarity is applied to the first sub-pixel R1 (i, j) and the fourth sub-pixel W1(i, j), and the drive voltage of negative polarity is applied to the second sub-pixel G1(i, j) and the third sub-pixel B1 (i, j), such that the polarities of the drive voltages of the first position sub-pixels and the second position sub-pixels in the same pixel unit are opposite.

According to the step S104, as shown in FIG. 3, the drive voltage of an H level is applied to the R1 sub-pixel, the G1 sub-pixel, the B1 sub-pixel and the W1 sub-pixel in the first pixel unit P1, and the drive voltage of an L level is applied to the R2, sub-pixel, the G2 sub-pixel, the B2 sub-pixel and the W2 sub-pixel in the second pixel unit P2, such that the levels of the drive voltages of each adjacent two of the pixel units are different.

By adopting the above driving method, in each row of pixels of the display panel, an amount of the sub-pixels applied with the positive polarity high voltage level (H+) equals to an amount of the sub-pixels applied with the negative polarity high voltage level (H−), for example, in each row in FIG. 3, there are 4 sub-pixels applied with the positive polarity high voltage level (H+) and 4 sub-pixels applied with the negative polarity high voltage level respectively. Due to the same amount of the sub-pixels of the high voltage level positive and negative polarities, the $V_{com}$ voltage is prevented from being affected by stray capacitance, thereby ensuring correctness of an image signal, and avoiding a phenomenon of color cast or abnormal picture quality.

In one embodiment, the above driving method further includes driving a same column of sub-pixels by adopting a driving voltage of a same polarity. As shown in FIG. 3, the jth column of R subpixels are applied with the positive polarity drive voltage, the jth column of G sub-pixels are applied with the negative polarity drive voltage, the jth column of B sub-pixels are applied with the negative polarity drive voltage, and the jth column of W sub-pixels are applied with the positive polarity drive voltage. In this way, the polarities of the drive voltages of the sub-pixels in the same column are same, differences among a plurality of voltage signals output by a same data line are kept within a smaller range, and heating of a data drive chip or distortion of the voltage signal can be avoided, thereby further improving display quality of respective sub-pixels. For example, in the above driving method, when the steps S102, S103 and S104 are performed, the sub-pixels in the same column are driven by adopting the drive voltage of the same polarity.

In one embodiment, the driving method further includes driving the sub-pixels in corresponding positions in respective pixel units by adopting a drive voltage of a same polarity in the same pixel unit group. For example, when the steps S102, S103 and S104 are performed, the drive voltage of the same polarity is adopted to drive the sub-pixels in corresponding positions in each pixel unit in the same pixel unit group. Specifically, each pixel unit includes a first sub-pixel, a second subpixel, a third subpixel and a fourth subpixel arranged in sequence, then the drive voltage of the same polarity is applied to the first sub-pixels of all pixel units in the same pixel unit group, the drive voltage of the same polarity is applied to the second sub-pixels of all pixel units in the same pixel unit group, the drive voltage of the same polarity is applied to the third sub-pixels of all pixel units in the same pixel unit group, and the drive voltage of the same polarity is applied to the fourth sub-pixels of all pixel units in the same pixel unit group. As shown in FIG. 3, by taking the nth pixel unit as an example, the drive voltage of the positive polarity is applied to the R sub-pixels of all pixel units in the nth pixel unit group, the drive voltage of the negative polarity is applied to the G sub-pixels of all pixel units in the nth pixel unit group, the drive voltage of the negative polarity is applied to the B sub-pixels of all pixel units in the nth pixel unit group, and the drive voltage of the positive polarity is applied to the W sub-pixels of all pixel units in the nth pixel unit group, in this way, the polarities of the drive voltage of the same column of sub-pixels are same, differences among a plurality of voltage signals output by a same data line are kept within a smaller range, and heating of a data drive chip or distortion of the voltage signal can be avoided, thereby further improving display quality of respective sub-pixels. In the same row, an amount of the sub-pixels of the positive polarity is equal to an amount of the sub-pixels of the positive polarity, such that the $V_{com}$ is prevented from being affected by stray capacitance, thereby ensuring correctness of an image signal, and avoiding a phenomenon of a color cast or abnormal picture quality.

In one embodiment, if the above display panel is a liquid crystal panel, considering that if liquid crystal pixels are driven by a DC electric field, chemical reaction of a liquid crystal material is easily caused, and electrode ageing is accelerated, and further a service life of the display panel is shortened. Therefore, in order to protect the liquid crystal material and electrodes and prolong the service life of the display panel, each sub-pixel in the display panel is driven by an alternating current. In one embodiment, the display panel is a liquid crystal panel. In one embodiment, the above driving method further includes driving the same sub-pixel by adopting the drive voltages of opposite polarities in every adjacent two frame display time. That is, for the same sub-pixel, in every adjacent two frame display time, the driving voltages of different polarities are applied respectively to achieve the AC driving effect. For example, by taking the sub-pixels in the nth pixel unit group as an example, in mth frame display time, the drive voltage as shown in FIG. 3 is applied to the sub-pixels in the nth pixel unit group, while in (m+1)th frame display time, the drive voltage as shown in FIG. 4 is applied to the sub-pixels in the nth pixel unit group. It can be seen that in every adjacent two frame display time, the polarity of the drive voltage of the same sub-pixel is changed, but the drive voltage level is kept unchanged. In this way, the AC driving for each sub-pixel is realized, the liquid crystal material and electrodes are protected, and the service life of the liquid crystal display panel is prolonged.

As an embodiment, when the display panel is driven, for each sub-pixel, after the voltage level and polarity of the drive voltage are determined, the drive voltage of each sub-pixel is obtained according to image data of each sub-pixel, and the corresponding polarity and voltage level of the drive voltage, and the drive voltage is applied to each sub-pixel by the data line.

The embodiment of the disclosure further provides a driving device 50 for a display panel. The display panel has a plurality of pixel units distributed in a matrix, wherein the pixel units include a plurality of first pixel units and a plurality of second pixel units, the first pixel units and the second pixel units are disposed adjacently, or the first pixel units and the second pixel units are alternately disposed.

As shown in FIG. 5, the driving device 50 includes a grouping module 510, a first drive module 520, a second drive module 530 and a third drive module 540, wherein the grouping module 510 is configured for dividing a plurality of pixel units of the display panel into a plurality of pixel unit groups, each of the pixel unit groups including two columns of adjacent pixel units; the first drive module 520 is configured for driving sub-pixels in corresponding positions in each adjacent two of the pixel unit groups by adopting drive voltages of opposite polarities; the second drive module 530 is configured for driving first position sub-pixels and second position sub-pixels in a same pixel unit by adopting drive voltages of opposite polarities; and the third drive module 540 is configured for driving the sub-pixels in the first pixel units and sub-pixels in the second pixel units respectively by adopting drive voltages of different voltage levels. In this way, not only are the voltage levels of the drive voltages of each adjacent two of the pixel units different and is the problem of color cast under the side viewing angle improved, but also in each row of pixels of the display panel, an amount of the sub-pixels with the drive voltage being the positive polarity high voltage level is equal to an amount of the sub-pixels with the drive voltage being the negative polarity high voltage level, such that the $V_{com}$ is prevented from being affected by stray capacitance, thereby ensuring correctness of an image signal, and avoiding a phenomenon of a color cast or abnormal picture quality.

Figure 6:
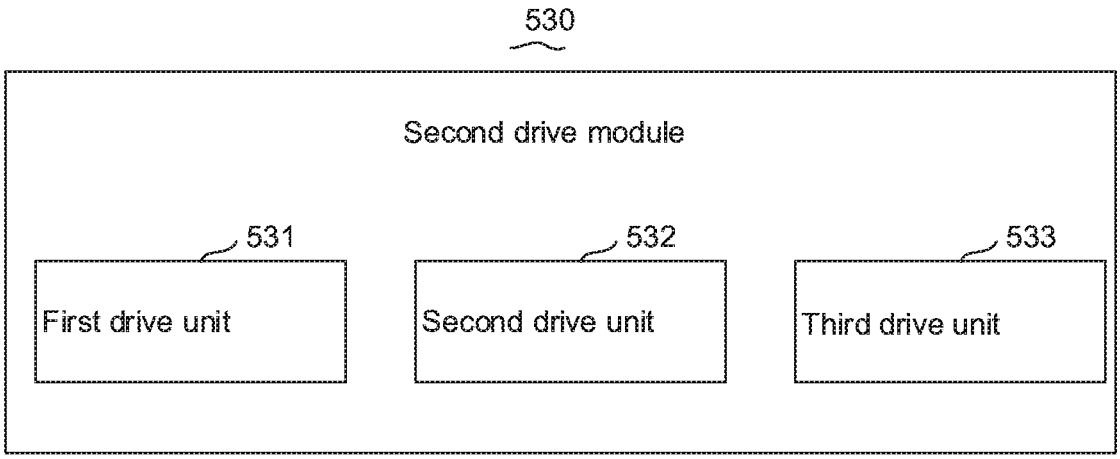
FIG. 6 is a structural schematic view of a second drive module in a driving device according to an embodiment of the disclosure.

In one of the embodiments, each of the pixel units includes a first sub-pixel, a second sub-pixel, a third sub-pixel and a fourth sub-pixel arranged in sequence; as shown in FIG. 6, the second drive module 530 includes a first drive unit 531, a second drive unit 532 and a third drive unit 533, wherein the first drive unit 531 is configured for driving the first sub-pixel and the second sub-pixel in a same pixel unit by adopting drive voltages of opposite polarities; the second drive unit 532 is configured for driving the fourth sub-pixel in the same pixel unit by adopting a drive voltage same as a polarity of the first sub-pixel; and the third drive unit 533 is configured for driving the third sub-pixel in the same pixel unit by adopting a drive voltage same as a polarity of the second sub-pixel.

In one of the embodiments, the driving device 50 further includes a fourth drive module, configured for driving a same column of sub-pixels by adopting a driving voltage of a same polarity. In this way, the polarities of the drive voltages of the sub-pixels in the same column are same, differences among a plurality of voltage signals output by a same data line are kept within a smaller range, and heating of a data drive chip or distortion of the voltage signal can be avoided, thereby further improving display quality of respective sub-pixels.

In one of the embodiments, the driving device 50 further includes a fifth drive module, configured for driving the sub-pixels in corresponding positions in respective pixel units by adopting a drive voltage of a same polarity in the same pixel unit group. In this way, the polarities of the drive voltage of the same column of sub-pixels are same, differences among a plurality of voltage signals output by a same data line are kept within a smaller range, and heating of a data drive chip or distortion of the voltage signal can be avoided, thereby further improving display quality of respective sub-pixels. In the same row, an amount of the sub-pixels of the positive polarity is equal to an amount of the sub-pixels of the negative polarity, such that the $V_{com}$ is prevented from being affected by stray capacitance, thereby ensuring correctness of an image signal, and avoiding a phenomenon of a color cast or abnormal picture quality.

In one of the embodiments, the driving device 50 further includes a sixth drive module, configured for driving the same sub-pixel by adopting the drive voltages of opposite polarities in every adjacent two frame display time. In this way, the AC driving for each sub-pixel is realized, the liquid crystal material and electrodes are protected, and the service life of the liquid crystal display panel is prolonged.

In one of the embodiments, in the driving device, each of the pixel units includes a first sub-pixel, a second sub-pixel, a third sub-pixel and a fourth sub-pixel arranged in sequence; the second drive module includes a first drive unit, configured for driving the first sub-pixel and the second sub-pixel in a same pixel unit by adopting drive voltages of opposite polarities; a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel; the driving device further includes a fourth drive module, configured for driving a same column of sub-pixels by adopting a driving voltage of a same polarity; a fifth drive module, configured for driving the sub-pixels in corresponding positions in respective pixel units by adopting a drive voltage of a same polarity in the same pixel unit group; and a sixth drive module, configured for driving the same sub-pixel by adopting the drive voltages of opposite polarities in every adjacent two frame display time. Further, the display panel is a liquid crystal panel.

In one of the embodiments, the driving device further includes an interchanging unit, connected to the drive module; the interchanging unit is configured for interchanging the first drive voltage level and the second drive voltage level once every a preset time period, that is, the interchanging unit is configured for, every time period or every preset time period, updating the first drive voltage level and the second drive voltage level, setting the first drive voltage level to be the original second drive voltage level and setting the second drive voltage level to be the original first drive voltage level, in this way, on the basis that a gray scale brightness curve of the pixel unit under a side viewing angle is close to the gray scale brightness curve under a front viewing angle, long term operation is further ensured to achieve a uniform display effect. Further, the preset time period is set or adjusted according to adjacent two frame display time, or the preset time period is set or adjusted according to a frame frequency. Further, the preset time period is in direct proportion to the adjacent two frame display time, or the preset time period is in inverse proportion to the frame frequency of the display panel. For example, the longer the adjacent two frame display time is, the longer the preset time period is, or the larger the frame frequency is, the smaller the preset time period is, and so on. That is to say, for different frame frequencies, the preset time period is different, thus, it can be ensured that the display panels of different display purposes have proper preset time periods. Therefore, the display of the display panel can be adapted when the first drive voltage level and the second drive voltage level are adjusted. Further the interchanging unit is further configured for presetting the preset time period. Further the interchanging unit is configured for presetting an amplitude of variation coefficient range. Interchanging the first drive voltage level and the second drive voltage level once every a preset time period includes interchanging the first drive voltage level and the second drive voltage level once every a preset time period and randomly obtaining an amplitude of variation coefficient according to the amplitude of variation coefficient range in the interchanging process; for example, every preset time period, the first drive voltage level and the second drive voltage level are updated, the first drive voltage level is set to be a product of the original second drive voltage level multiplied by an amplitude of variation coefficient randomly obtained from the amplitude of variation coefficient range, and the second drive voltage level is set to be a product of the original first drive voltage level multiplied by an amplitude of variation coefficient randomly obtained from the amplitude of variation coefficient range. For example, the interchanging unit is further configured for setting the two amplitude of variation coefficients to be same or different in the interchanging process. For example, every preset time period, the first drive voltage level and the second drive voltage level are updated, an amplitude of variation coefficient is randomly obtained from the amplitude of variation coefficient range, the first drive voltage level is set to be a product of the original second drive voltage level multiplied by the amplitude of variation coefficient, and the second drive voltage level is set to be a product of the original first drive voltage level multiplied by the amplitude of variation coefficient. It is understandable that different voltage levels correspond to different drive voltages. In this way, on the basis that a gray scale brightness curve of the pixel unit under a side viewing angle is close to the gray scale brightness curve under a front viewing angle, long term operation is further ensured to achieve a uniform display effect, better protection for the display panel is formed, and such design is favorable for improving a picture display quality.

Wherein the column and row in the embodiment of the disclosure represent two arrangement directions vertical to each other, for example, the column represents a longitudinal direction and the row represents a transverse direction; and for another example, the column represents the transverse direction and the row represents the longitudinal direction. That is, the column in the embodiment of the disclosure may be the row understood by those ordinary skilled in the art, and the row in the embodiment of the disclosure may be the column understood by those ordinary skilled in the art.

Another embodiment of the disclosure provides a driving device for a display panel, which adopts the driving method for a display panel according to any above embodiment. For example, the driving device for a display panel is implemented by adopting the driving method for a display panel according to any above embodiment. For another example, the driving device for a display panel has function modules corresponding to the driving method for a display panel according to any above embodiment.

The driving method and driving device for a display panel according to the present application may be for example applied to a liquid crystal display panel, an organic light-emitting diode (OLED) display panel, a quantum dot light emitting diodes (QLED) display panel, a curve surface display panel, or a flexible display panel, etc. For another example, the liquid crystal display panel as an example may be a twisted nematic (TN) liquid crystal display panel, an in-plane switching (IPS) liquid crystal display panel, a plane to line switching (PLS) liquid crystal display panel, or a multi-domain vertical alignment (MVA) liquid crystal display panel, etc. The display panel may be driven by adopting a logic board of a full high definition display panel. That is, the above driving method and driving device for a display panel may be implemented by adopting the logic board of the full high definition display panel.

Figure 7:
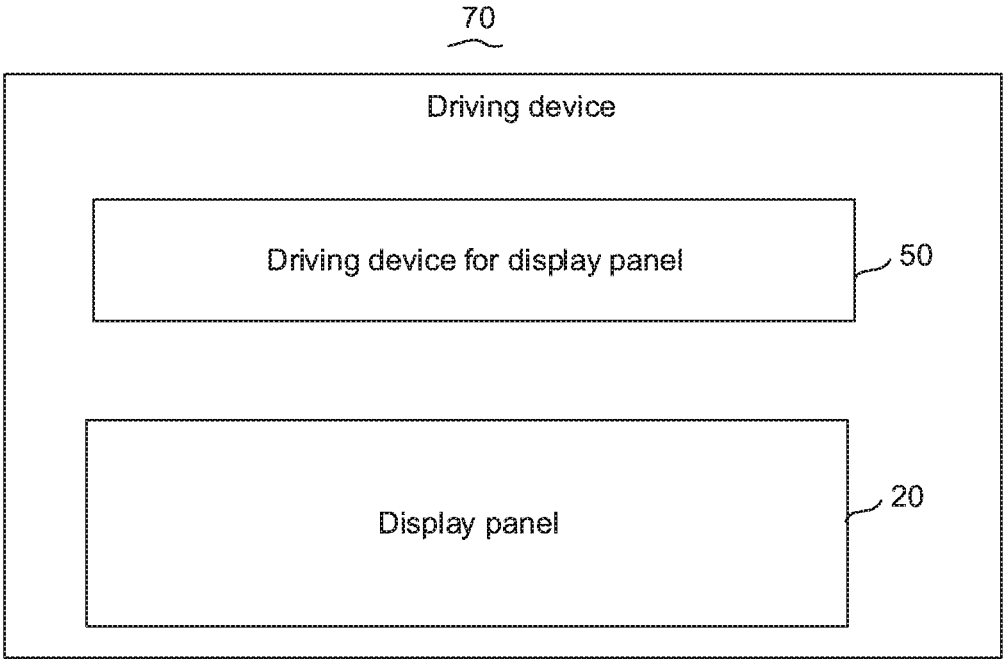
FIG. 7 is a structural schematic view of a display device according to an embodiment of the disclosure.

The disclosure further discloses a display device, as shown in FIG. 7, the display device 70 includes a display panel 20 and the driving device 50 for a display panel according to any above embodiment.

For example, the display device 50 is a liquid crystal display device, an OLED display device, a QLED display device, a curve surface display device, a flexible display device, etc. For another example, the liquid crystal display device as an example may be a TN liquid crystal display, an IPS liquid crystal display, a PLS liquid crystal display or an MVA liquid crystal display, etc.

In one of the embodiments, the driving device includes a grouping module, configured for dividing a plurality of pixel units of the display panel into a plurality of pixel unit groups, each of the pixel unit groups including two columns of adjacent pixel units; a first drive module, configured for driving sub-pixels in corresponding positions in each adjacent two of the pixel unit groups by adopting drive voltages of opposite polarities; a second drive module, configured for driving first position sub-pixels and second position sub-pixels in a same pixel unit by adopting drive voltages of opposite polarities; a third drive module, configured for driving the sub-pixels in first pixel units and sub-pixels in second pixel units respectively by adopting drive voltages of different voltage levels; wherein the first pixel units and the second pixel units are disposed adjacently in the display panel.

In one of the embodiments, each of the pixel units includes a first sub-pixel, a second sub-pixel, a third sub-pixel and a fourth sub-pixel arranged in sequence; the second drive module includes a first drive unit, configured for driving the first sub-pixel and the second sub-pixel in a same pixel unit by adopting drive voltages of opposite polarities; a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel.

In one of the embodiments, the driving device further includes a fourth drive module, configured for driving a same column of sub-pixels by adopting a driving voltage of a same polarity.

In one of the embodiments, the driving device further includes a fifth drive module, configured for driving the sub-pixels in corresponding positions in respective pixel units by adopting a drive voltage of a same polarity in the same pixel unit group.

In one of the embodiments, the driving device further includes a sixth drive module, configured for driving the same sub-pixel by adopting the drive voltages of opposite polarities in every adjacent two frame display time.

In one of the embodiments, in the driving device, each of the pixel units includes a first sub-pixel, a second sub-pixel, a third sub-pixel and a fourth sub-pixel arranged in sequence; the second drive module includes a first drive unit, configured for driving the first sub-pixel and the second sub-pixel in a same pixel unit by adopting drive voltages of opposite polarities; a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel; the driving device further includes a fourth drive module, configured for driving a same column of sub-pixels by adopting a driving voltage of a same polarity; a fifth drive module, configured for driving the sub-pixels in corresponding positions in respective pixel units by adopting a drive voltage of a same polarity in the same pixel unit group; and a sixth drive module, configured for driving the same sub-pixel by adopting the drive voltages of opposite polarities in every adjacent two frame display time.

Respective technical characteristics of above embodiments can be freely combined, and for the purpose of compact description, not all possible combinations of the respective technical characteristics of above embodiments are described. However, as long as the combinations of these technical characteristics have no conflicts, they are considered to be within a scope of the specification.

The foregoing merely expresses several embodiments of the disclosure, which are described in a relatively specific and detailed manner, but should be understood as a limitation to the scope of the disclosure. It should be pointed out that those ordinary skilled in the art could make a plurality of transformations and improvements without departing from a concept of the disclosure, and they all fall within the protective scope of the disclosure. Therefore, a protective scope of the disclosure should take appended claims as a criterion.

What is claimed is:

1. A driving method for a display panel, comprising dividing a plurality of pixel units of the display panel into a plurality of pixel unit groups, each of the pixel unit groups comprising two columns of adjacent pixel units, wherein the pixel units comprises first pixel units and second pixel units;

driving sub-pixels in corresponding positions in each adjacent two of the pixel unit groups by adopting drive voltages of opposite polarities;

driving first position sub-pixels and second position sub-pixels in a same pixel unit by adopting drive voltages of opposite polarities;

driving the sub-pixels in the first pixel units and sub-pixels in the second pixel units respectively by adopting the drive voltages of different voltage levels;

wherein the first pixel units and the second pixel units are disposed adjacently in the display panel.

2. The driving method according to claim 1, wherein each of the pixel units comprises a first sub-pixel, a second sub-pixel, a third sub-pixel and a fourth sub-pixel arranged in sequence;

driving first position sub-pixels and second position sub-pixels in a same pixel unit by adopting drive voltages of opposite polarities comprises driving the first sub-pixel and the second sub-pixel in a same pixel unit by adopting drive voltages of opposite polarities;

driving the fourth sub-pixel in the same pixel unit by adopting a drive voltage same as a polarity of the first sub-pixel; and driving the third sub-pixel in the same pixel unit by adopting a drive voltage same as a polarity of the second sub-pixel.

3. The driving method according to claim 1, further comprising driving a same column of sub-pixels by adopting a driving voltage of a same polarity.

4. The driving method according to claim 1, further comprising driving the sub-pixels in corresponding positions in respective pixel units by adopting a drive voltage of a same polarity in the same pixel unit group.

5. The driving method according to claim 1, further comprising driving the same sub-pixel by adopting the drive voltages of opposite polarities in every adjacent two frame display time.

6. The driving method according to claim 1, wherein each of the pixel units comprises a first sub-pixel, a second sub-pixel, a third sub-pixel and a fourth sub-pixel arranged in sequence;

driving first position sub-pixels and second position sub-pixels in a same pixel unit by adopting drive voltages of opposite polarities comprises driving the first sub-pixel and the second sub-pixel in a same pixel unit by adopting drive voltages of opposite polarities;

driving the fourth sub-pixel in the same pixel unit by adopting a drive voltage same as a polarity of the first sub-pixel; and driving the third sub-pixel in the same pixel unit by adopting a drive voltage same as a polarity of the second sub-pixel;

besides, the driving method further comprises driving a same column of sub-pixels by adopting a driving voltage of a same polarity;

driving the sub-pixels in corresponding positions in respective pixel units by adopting a drive voltage of a same polarity in the same pixel unit group; and driving the same sub-pixel by adopting the drive voltages of opposite polarities in every adjacent two frame display time.

7. The driving method according to claim 1, wherein the display panel is a liquid crystal panel.

8. A driving device for a display panel, comprising a grouping module, configured for dividing a plurality of pixel units of the display panel into a plurality of pixel unit groups, each of the pixel unit groups comprising two columns of adjacent pixel units;

a first drive module, configured for driving sub-pixels in corresponding positions in each adjacent two of the pixel unit groups by adopting drive voltages of opposite polarities;

a second drive module, configured for driving first position sub-pixels and second position sub-pixels in a same pixel unit by adopting drive voltages of opposite polarities;

a third drive module, configured for driving the sub-pixels in first pixel units and sub-pixels in second pixel units respectively by adopting drive voltages of different voltage levels;

wherein the first pixel units and the second pixel units are disposed adjacently in the display panel.

9. The driving device according to claim 8, wherein each of the pixel units comprises a first sub-pixel, a second sub-pixel, a third sub-pixel and a fourth sub-pixel arranged in sequence;

the second drive module comprises a first drive unit, configured for driving the first sub-pixel and the second sub-pixel in a same pixel unit by adopting drive voltages of opposite polarities;

a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel.

10. The driving device according to claim 8, further comprising a fourth drive module, configured for driving a same column of sub-pixels by adopting a driving voltage of a same polarity.

11. The driving device according to claim 8, further comprising a fifth drive module, configured for driving the sub-pixels in corresponding positions in respective pixel units by adopting a drive voltage of a same polarity in the same pixel unit group.

12. The driving device according to claim 8, further comprising a sixth drive module, configured for driving the same sub-pixel by adopting the drive voltages of opposite polarities in every adjacent two frame display time.

13. The driving device according to claim 8, wherein each of the pixel units comprises a first sub-pixel, a second sub-pixel, a third sub-pixel and a fourth sub-pixel arranged in sequence;

the second drive module comprises a first drive unit, configured for driving the first sub-pixel and the second sub-pixel in a same pixel unit by adopting drive voltages of opposite polarities;

a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel;

the driving device further comprises a fourth drive module, configured for driving a same column of sub-pixels by adopting a driving voltage of a same polarity;

a fifth drive module, configured for driving the sub-pixels in corresponding positions in respective pixel units by adopting a drive voltage of a same polarity in the same pixel unit group; and a sixth drive module, configured for driving the same sub-pixel by adopting the drive voltages of opposite polarities in every adjacent two frame display time.

14. The driving device according to claim 8, wherein the display panel is a liquid crystal panel.

15. A display device, comprising a display panel and a driving device;

wherein the driving device comprises a grouping module, configured for dividing a plurality of pixel units of the display panel into a plurality of pixel unit groups, each of the pixel unit groups comprising two columns of adjacent pixel units;

a first drive module, configured for driving sub-pixels in corresponding positions in each adjacent two of the pixel unit groups by adopting drive voltages of opposite polarities;

a second drive module, configured for driving first position sub-pixels and second position sub-pixels in a same pixel unit by adopting drive voltages of opposite polarities;

a third drive module, configured for driving the sub-pixels in first pixel units and sub-pixels in second pixel units respectively by adopting drive voltages of different voltage levels;

wherein the first pixel units and the second pixel units are disposed adjacently in the display panel.

16. The display device according to claim 15, wherein each of the pixel units comprises a first sub-pixel, a second sub-pixel, a third sub-pixel and a fourth sub-pixel arranged in sequence;

the second drive module comprises a first drive unit, configured for driving the first sub-pixel and the second sub-pixel in a same pixel unit by adopting drive voltages of opposite polarities;

a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel.

17. The display device according to claim 15, further comprising a fourth drive module, configured for driving a same column of sub-pixels by adopting a driving voltage of a same polarity.

18. The display device according to claim 15, further comprising a fifth drive module, configured for driving the sub-pixels in corresponding positions in respective pixel units by adopting a drive voltage of a same polarity in the same pixel unit group.

19. The display device according to claim 15, further comprising a sixth drive module, configured for driving the same sub-pixel by adopting the drive voltages of opposite polarities in every adjacent two frame display time.

20. The display device according to claim 15, wherein each of the pixel units comprises a first sub-pixel, a second sub-pixel, a third sub-pixel and a fourth sub-pixel arranged in sequence;

the second drive module comprises a first drive unit, configured for driving the first sub-pixel and the second sub-pixel in a same pixel unit by adopting drive voltages of opposite polarities;

a second drive unit, configured for driving the fourth sub-pixel in the same pixel unit by adopting a drive voltage same as a polarity of the first sub-pixel; and a third drive unit, configured for driving the third sub-pixel in the same pixel unit by adopting a drive voltage same as a polarity of the second sub-pixel;

the driving device further comprises a fourth drive module, configured for driving a same column of sub-pixels by adopting a driving voltage of a same polarity;

a fifth drive module, configured for driving the sub-pixels in corresponding positions in respective pixel units by adopting a drive voltage of a same polarity in the same pixel unit group; and a sixth drive module, configured for driving the same sub-pixel by adopting the drive voltages of opposite polarities in every adjacent two frame display time.

* * * * *